US008398301B2

(12) United States Patent
Madhavan et al.

(10) Patent No.: US 8,398,301 B2
(45) Date of Patent: Mar. 19, 2013

(54) APPARATUS FOR DETERMINING DOWNHOLE FLUID TEMPERATURES

(75) Inventors: Raghu Madhavan, Houston, TX (US); Michael Stangeland, Tokyo (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 450 days.

(21) Appl. No.: 12/763,218

(22) Filed: Apr. 20, 2010

(65) Prior Publication Data

US 2011/0252879 A1 Oct. 20, 2011

(51) Int. Cl.
*E21B 47/06* (2012.01)
*G01K 7/02* (2006.01)

(52) U.S. Cl. ..... 374/141; 374/179; 73/152.12; 73/152.55

(58) Field of Classification Search ..... 374/137, 374/141, 179; 73/152.12, 152.55
See application file for complete search history.

(56) References Cited

U.S. PATENT DOCUMENTS 4,860,581 A 8/1989 Zimmerman et al.
4,936,139 A 6/1990 Zimmerman et al.
5,509,474 A * 4/1996 Cooke, Jr. ..... 166/64
5,551,287 A * 9/1996 Maute et al. ..... 73/152.02
5,887,978 A * 3/1999 Lunghofer et al. ..... 374/179
5,931,580 A * 8/1999 Wyland ..... 374/141
6,227,045 B1 * 5/2001 Morse et al. ..... 73/204.22
6,827,486 B2 * 12/2004 Welker ..... 374/147
7,467,891 B2 * 12/2008 Gennissen et al. ..... 374/143
8,322,196 B2 * 12/2012 Madhavan et al. ..... 73/54.41
2004/0173017 A1 * 9/2004 O'Brien ..... 73/152.55
2007/0121701 A1 * 5/2007 Gennissen et al. ..... 374/143
2008/0107151 A1 * 5/2008 Khadkikar et al. ..... 374/141
2011/0299562 A1 * 12/2011 Hashemian ..... 374/1
2011/0299567 A1 * 12/2011 Rud et al. ..... 374/181

* cited by examiner

*Primary Examiner* — Christopher Fulton

(74) *Attorney, Agent, or Firm* — Jianguang Du; Jody DeStephanis

(57) ABSTRACT

Apparatus for determining downhole fluid temperatures are described. An example apparatus for measuring a temperature of a downhole fluid includes a sensing element for measuring a physical or chemical property of the downhole fluid, and a plurality of electrical connections to enable the sensing element to measure the chemical or physical property and provide an output signal representative of the chemical or physical property, wherein at least one of the electrical connections is configured to function as a thermocouple to sense a temperature of the downhole fluid.

20 Claims, 8 Drawing Sheets

APPARATUS FOR DETERMINING DOWNHOLE FLUID TEMPERATURES

FIELD OF THE DISCLOSURE

This disclosure relates generally to downhole fluid measurement and, more particularly, to apparatus for determining downhole fluid temperatures.

BACKGROUND

Measurements of subterranean hydrocarbon-bearing fluid characteristics are often dependent on temperature of the measured fluid. For example, the viscosity of a fluid increases as the temperature of the fluid decreases. When reporting the measured characteristics of a fluid, the characteristic may be reported in terms of its relationship to temperature, either at one or more discrete temperature points or over a range of temperatures.

DETAILED DESCRIPTION

Figure 2:
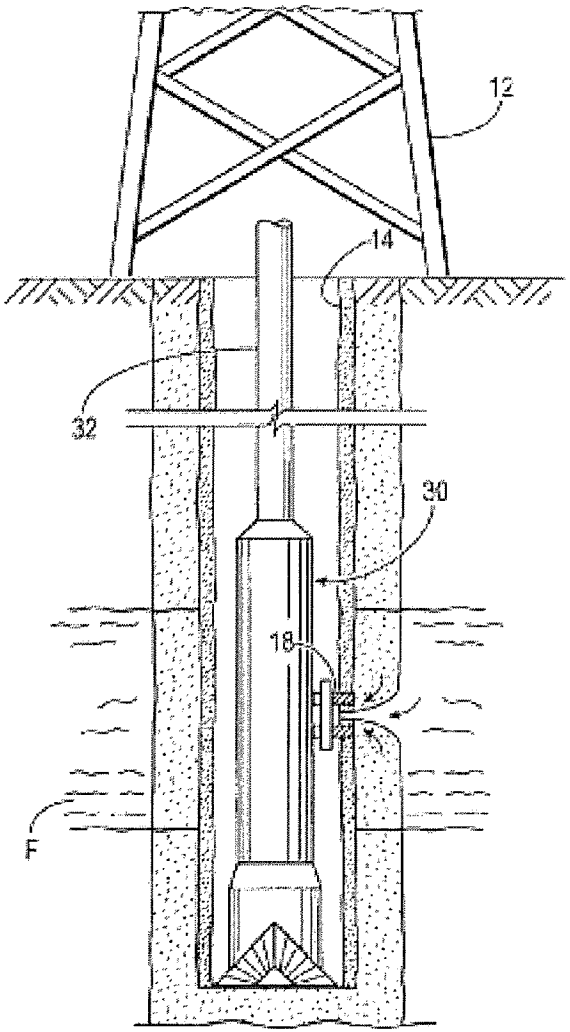
FIG. 2 depicts a drilling tool that may employ the example sensors described herein.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness. Accordingly, while the following describes example apparatus, persons of ordinary skill in the art will readily appreciate that the examples are not the only way to implement such apparatus.

Different aspects and/or features of the example vibrating wire viscometers are described herein. Many of these different aspects and/or features may be combined to realize the respective advantages of these aspects and/or features. Different applications and implementations of the temperature sensors described herein may benefit from some combination of the below-described features compared to other combinations.

The example apparatus described herein may be used to measure the temperature of a downhole fluid. In some known systems, a resistance temperature detector (RTD, also known as a resistive thermal device) is disposed near a fluid chamber or flowline. While RTDs are accurate and have repeatable responses, RTDs tend to be fragile and, thus, are not typically exposed to the downhole fluid. As a result, any material disposed between the RTD and the fluid partially insulates the RTD from changes in fluid temperature, which reduces the speed at which the RTD may detect changes in the fluid temperature.

In contrast, the example apparatus described below may measure changing fluid temperatures more rapidly than known temperature-sensing devices. In particular, the example apparatus described herein include temperature sensors that are exposed to downhole fluids. Additionally, some example temperature sensors are used for additional sensing purposes, such as downhole fluid viscosity sensing, resistivity sensing, and/or downhole fluid hydrogen sulfide (H2S) sensing.

Some example apparatus described herein including a sensing element for measuring a physical or chemical property of the downhole fluid (e.g., viscosity, H2S concentration). The example apparatus further include a plurality of electrical connections to enable the sensing element to measure the chemical or physical property and provide an output signal (e.g., a voltage, a current) representative of the chemical or physical property. In some examples, at least one of the electrical connections is configured to function as a thermocouple to sense a temperature of the downhole fluid, and a fluid thermometer is coupled to the thermocouple to measure the sensed temperature.

Some examples described below include a thermocouple that is exposed to the downhole fluid and a reference temperature sensor that is disposed near the downhole fluid and which is not exposed to (i.e., is not in direct contact with) the downhole fluid. The reference temperature sensor determines a reference temperature at a downhole reference location. The thermocouple is used to determine a difference in temperature between the fluid and the downhole reference location. In the described examples, a fluid thermometer determines the temperature of the downhole fluid based on the reference temperature and the temperature difference determined by the thermocouple. As temperature equilibrium occurs between the downhole fluid and the reference location, the fluid thermometer determines that the difference measured by the thermocouple is about zero.

Figure 1:
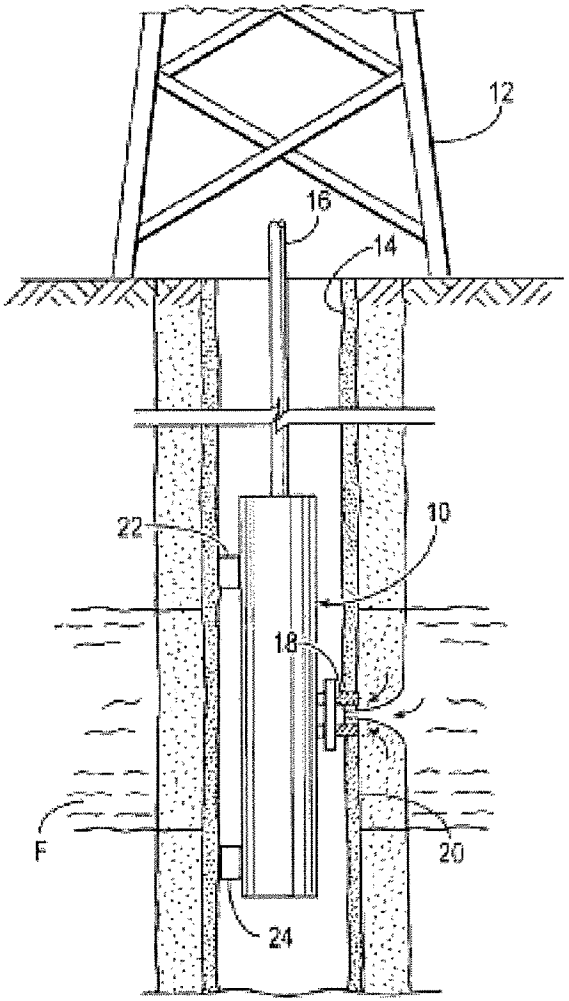
FIG. 1 depicts a wireline tool that is suspended from a rig in a wellbore and which may employ the example sensors described herein.

FIG. 1 depicts a downhole tool 10, which is suspended from a rig 12 in a wellbore 14 and which may employ the example sensors described herein. The downhole tool 10 can be any type of tool capable of performing formation evaluation and may be conveyed by wireline, drillstring, coiled tubing, or slickline. The downhole tool 10 of FIG. 1 is a conventional wireline tool deployed from the rig 12 in the wellbore 14 via a wireline cable 16 and positioned adjacent to a formation F. The downhole tool 10 is provided with a probe 18 adapted to seal against a wall 20 of the wellbore 14 (hereinafter referred to as a "wall 20" or "wellbore wall 20") and draw fluid from the formation F into the downhole tool 10 as depicted by the arrows. Backup pistons 22 and 24 assist in pushing the probe 18 of the downhole tool 10 against the wellbore wall 20. Additionally or alternatively, other types of sealing devices, such as dual packers, may be used to channel formation fluid into the downhole tool 10 as described in U.S. Pat. No. 4,860,581.

FIG. 2 depicts another downhole tool 30 that may employ the example sensors described herein. The downhole tool 30 of FIG. 2 is a drilling tool, which can be conveyed among one or more (or itself may be) a measurement-while-drilling (MWD) drilling tool, a logging-while-drilling (LWD) drilling tool, or other drilling tool known to those skilled in the art. The downhole tool 30 is attached to a drillstring 32 driven by the rig 12 to form the wellbore 14. The downhole tool 30 includes the probe 18 adapted to seal against the wall 20 of the wellbore 14 to draw fluid from the formation F into the downhole tool 30 as depicted by the arrows.

Figure 3:
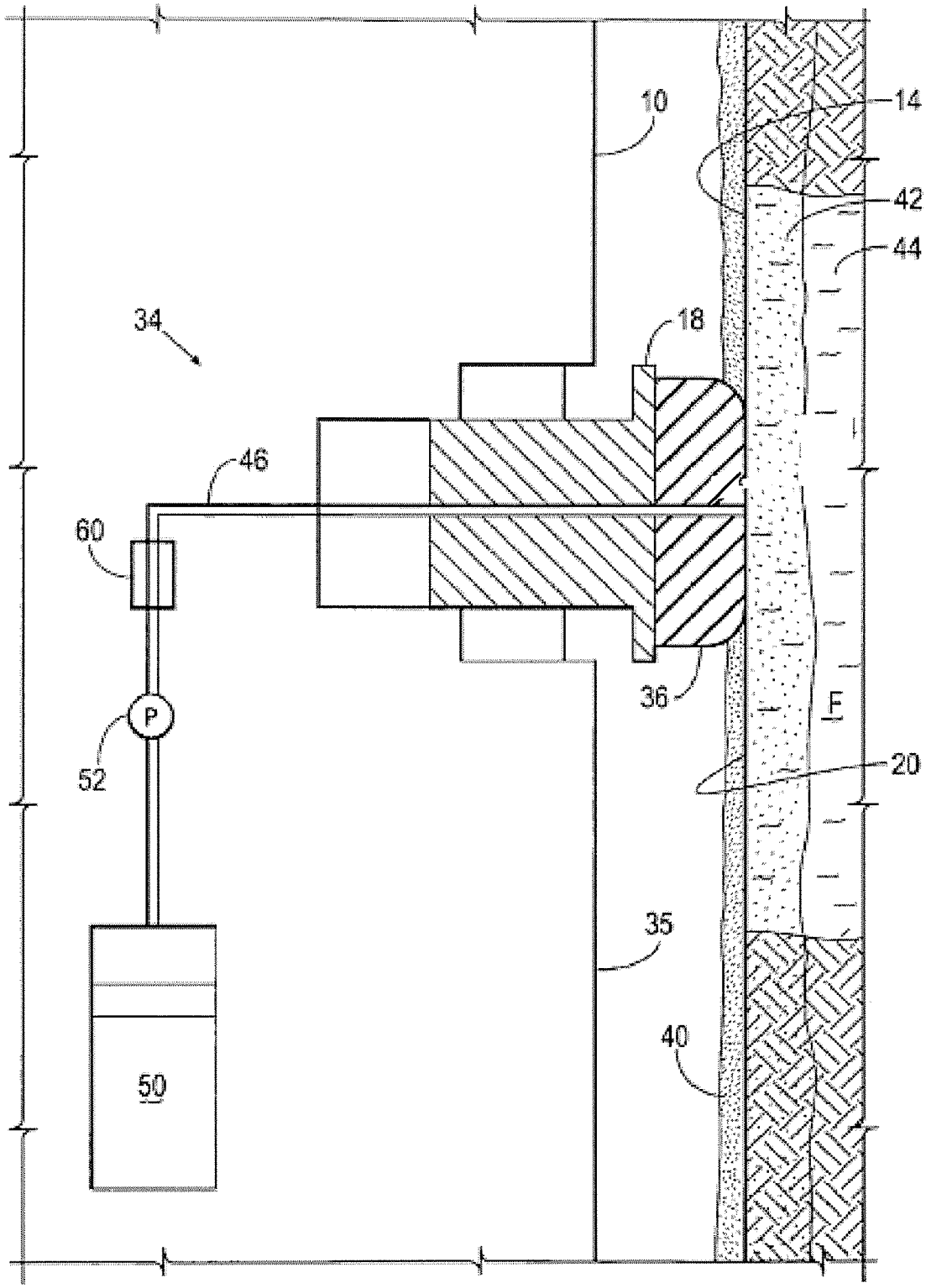
FIG. 3 is a schematic view of a portion of the downhole tool of FIG. 1 depicting a fluid sampling system.

FIG. 3 is a schematic view of a portion of the downhole tool 10 of FIG. 1 depicting a fluid sampling system 34. The probe 18 is preferably extended from a housing 35 of the downhole tool 10 for engagement with the wellbore wall 20. The probe 18 is provided with a packer 36 for sealing against the wellbore wall 20. The packer 36 contacts the wellbore wall 20 and forms a seal with a mud cake 40 lining the wellbore 14. Portions of the mud seep into the wellbore wall 20 and create an invaded zone 42 about the wellbore 14. The invaded zone 42 contains mud and other wellbore fluids that contaminate the surrounding formations, including the formation F and a portion of the virgin fluid 44 contained therein.

The probe 18 is preferably provided with an evaluation flowline 46. Examples of fluid communication devices, such as probes and dual packers, used for drawing fluid into a flowline are depicted in U.S. Pat. Nos. 4,860,581 and 4,936,139.

The evaluation flowline 46 extends into the downhole tool 10 and is used to pass fluid, such as virgin fluid 44, into the downhole tool 10 for testing and/or sampling. The evaluation flowline 46 extends to a sample chamber 50 for collecting samples of the virgin fluid 44 or may be redirected to discard the sample. A pump 52 may be used to draw fluid through the flowline 46.

While FIG. 3 shows a sample configuration of a downhole tool used to draw fluid from a formation, it will be appreciated by one of skill in the art that a variety of configurations of probes, flowlines and downhole tools may be used and is not intended to limit the scope of the invention.

In accordance with the present invention, a fluid thermometer 60 is associated with an evaluation cavity within the downhole tool 10, such as the evaluation flowline 46 for measuring the viscosity and/or H2S concentration of the fluid within the evaluation cavity. Example implementations of the fluid thermometer 60 are described in more detail in connection with FIGS. 4-10.

The downhole tool 30 may also be provided with the housing 35, the probe 18, the fluid flow system 34, the packer 36, the evaluation flowline 46, the sample chamber 50, the pump(s) 52 and the fluid thermometer(s) 60 in a similar manner as the downhole tool 10.

Figure 4A:
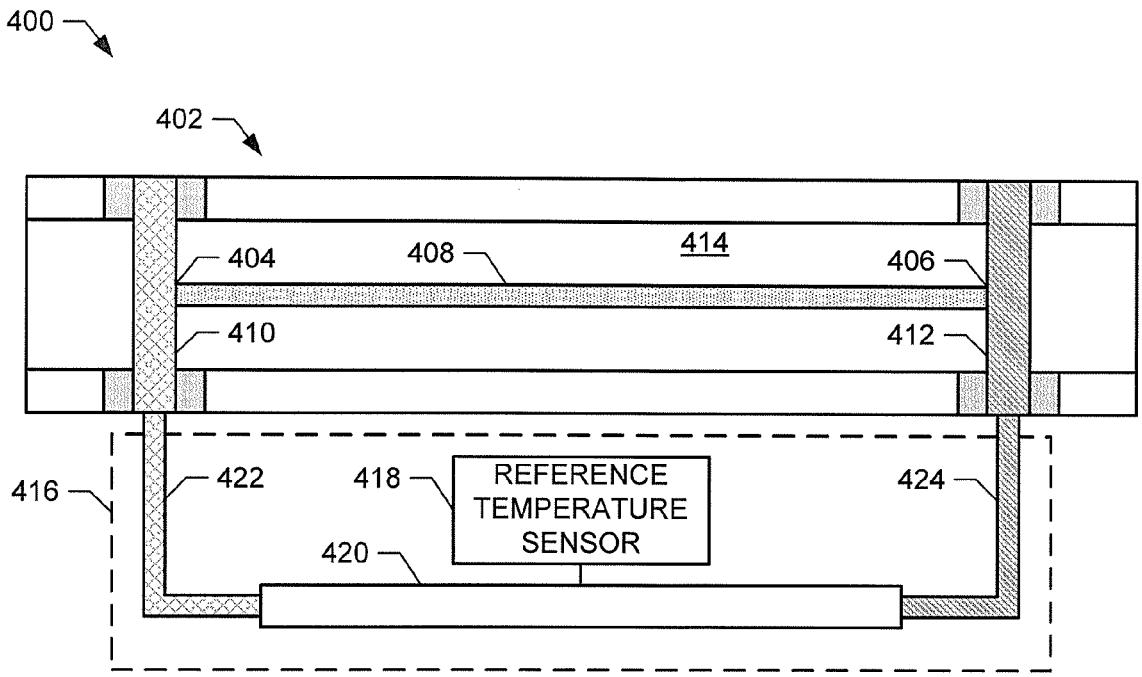
FIG. 4A is an example vibrating wire viscometer constructed to also provide a temperature sensor via thermocouple junctions between a wire and conductive posts.

FIG. 4A is an example vibrating wire viscometer 400 constructed to also provide a temperature sensor 402 via thermocouple junctions 404 and 406 between a wire 408 and respective conductive posts 410 and 412. The vibrating wire viscometer 400 may be used to determine both the viscosity of a downhole fluid in a fluid chamber 414 (e.g., the flowline 46 and/or the sample chamber 50 of FIG. 3) and the temperature of the fluid at which the viscosity measurements are taken. The temperature sensor 402 uses the thermoelectric properties of the materials in the vibrating wire viscometer 400 to determine the temperature of the downhole fluid. U.S. patent application Ser. No. 12/534,151, filed on Aug. 2, 2009, now U.S. Pat. No. 8,322,196 describes several example vibrating wire viscometers that may be used to implement any of the vibrating wire viscometers described in FIGS. 4-6.

The example wire 408 is composed of tungsten. The posts 410 and 412 support the wire 408 and hold the wire 408 in tension to perform viscosity measurements. Additionally, the posts 410 and 412 are composed of conductive materials. However, in the example of FIG. 4A the posts 410 and 412 are composed of materials that are different than each other and different than the tungsten wire 408. When the posts 410 and 412 are composed of different materials than the wire 408, the junctions 404 and 406 at which the respective posts 410 and 412 are attached to the wire 408 can function as thermocouples. A thermocouple, as used herein, is a junction between two dissimilar metals that, when heated, produces a voltage proportional to a Seebeck coefficient representative of the junction. The terms "thermocouple," "junction," and "thermocouple junction" are used interchangeably throughout this description. Thus, the junction 404 is a first thermocouple having a first Seebeck coefficient and the junction 406 is a second thermocouple having a second Seebeck coefficient. To increase the net voltage produced by the junctions 404 and 406, the materials for the respective posts 410 and 412 may be selected to increase the difference between the first and second Seebeck coefficients. Such an increase in the difference between the Seebeck coefficients increases the sensitivity of the temperature sensor 402.

The example vibrating wire viscometer 400 further includes a reference location, area, or point 416 that is separate from the fluid chamber 414. A reference temperature sensor 418 senses the temperature of the reference location 416 and provides temperature information (e.g., a signal or value representative of a temperature) to a fluid thermometer 420. The fluid thermometer 420 is further coupled to the conductive posts 410 and 412 via connectors 422 and 424 (e.g., conductors, connecting wires). In the illustrated example, the connector 422 is composed of the same material as the post 410 and the connector 424 is composed of the same material as the post 412 to avoid forming additional thermocouple junctions between the connectors 422 and 424 and the posts 410 and 412. However, in some examples, the connectors 422 and 424 are both composed of a material that is different than the materials used for the wire 408 and the posts 410 and 412. The fluid thermometer 420 may be disposed near one or more components used to determine the viscosity of downhole fluid in the fluid chamber 414. The wire 408, the posts 410 and 412, and the connectors 422 and 424 may be used simultaneously for viscosity measurements and temperature measurements.

The reference temperature sensor 418 may be implemented using, for example, an RTD, a thermistor, a silicon bandgap temperature sensor, an infrared thermometer, a heat flux sensor, or another suitable type of temperature sensor. In operation, the fluid thermometer 420 receives the temperature (or a signal indicative or representative thereof) of the reference location 416 from the reference temperature sensor 418. The junctions 404 and 406 generate a voltage based on the difference in temperature between the reference location 416 and the downhole fluid in the fluid chamber 414. The fluid thermometer 420 measures the voltage difference between the connectors 422 and 424 and uses the difference to determine the temperature of the downhole fluid in the fluid chamber 414.

Fluid in the fluid chamber 414 around the junctions 404 and 406 generally has an even temperature. As a result, the junctions 404 and 406 adjust to the same temperature as the fluid. When the junctions 404 and 406 are at substantially the same temperature, the voltage measured by the fluid thermometer 420 depends on the difference in the Seebeck properties (e.g., coefficients) of the junctions 404 and 406. The measured voltage may be calibrated to estimate the temperature difference between the reference location 416 and either of the junctions 404 or 406.

The temperature of the downhole fluid in the fluid chamber 414 may remain substantially constant and/or may change. When the temperature remains constant for a sufficiently long time, the temperature of the reference location 416 substantially equals the temperature of the downhole fluid. As a result, the temperature difference determined by the junctions 404 and 406 becomes substantially zero, and the fluid thermometer 420 determines that the temperature of the downhole fluid in the fluid chamber 414 is substantially equal to the temperature determined by the reference temperature sensor 418. However, when the temperature of the fluid in the fluid chamber 416 changes, the junctions 404 and 406 rapidly react to the changes in temperature. In response, the fluid thermometer 420 detects the transient voltage change of the junctions 404 and 406 to determine the temperature of the downhole fluid in the fluid chamber 414.

Figure 4B:
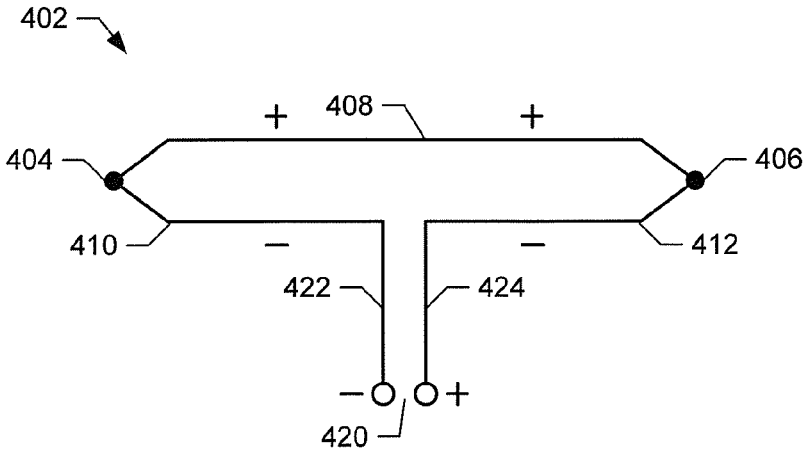
FIG. 4B is a schematic view of the example temperature sensor of FIG. 4A.

FIG. 4B is a schematic view of the example temperature sensor 402 of FIG. 4A. In operation, the junctions 404 and 406 generate respective voltages based on their respective Seebeck coefficients and the temperature of the junctions 404 and 406. The fluid thermometer 420, which is calibrated with the Seebeck coefficients of the junctions 404 and 406, measures the sum of the voltages to determine the temperature of a downhole fluid.

Figure 4C:
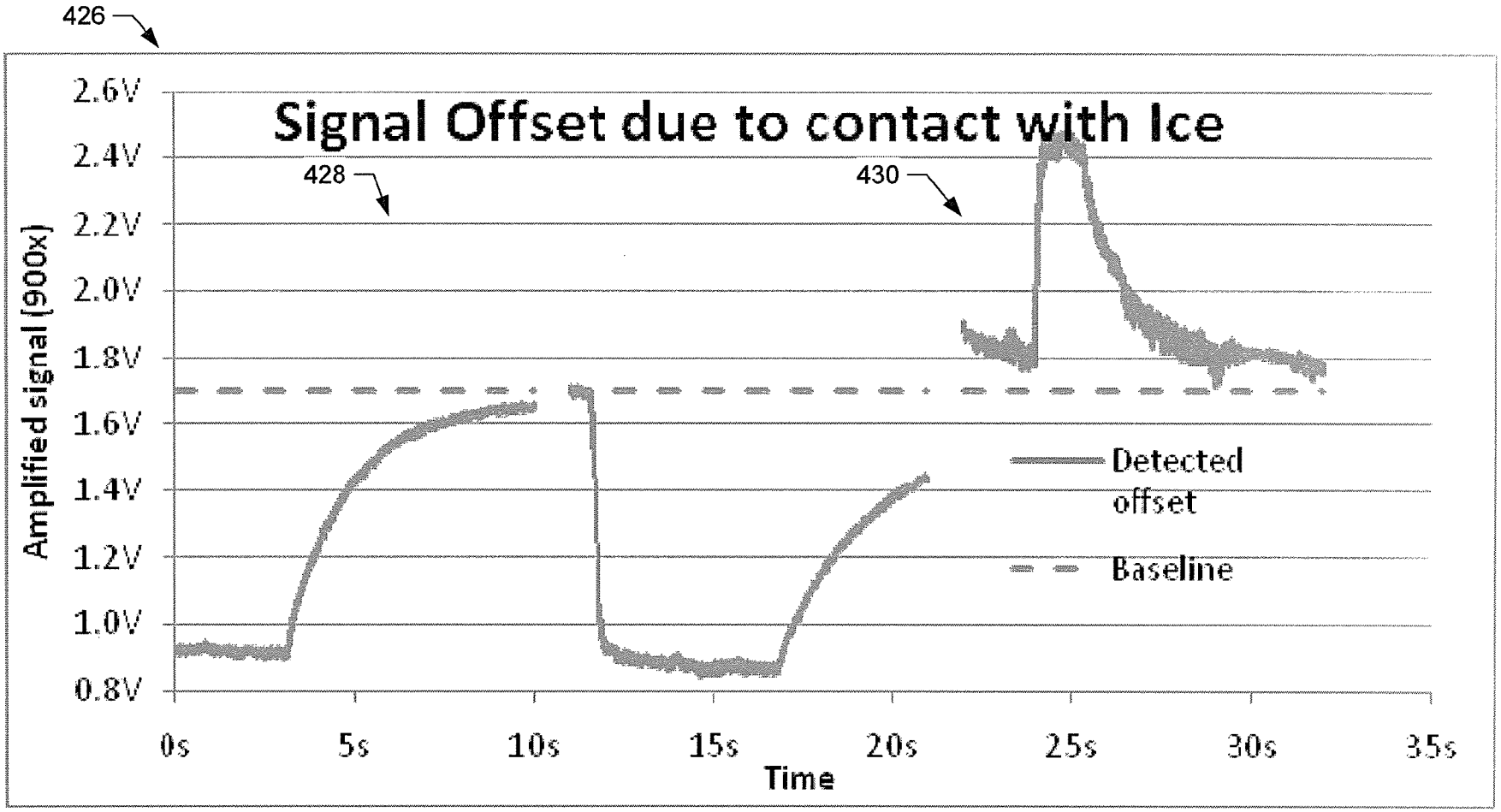
FIG. 4C is a graph illustrating example test results using the vibrating wire viscometer illustrated in FIG. 4A.

FIG. 4C is a graph illustrating example test results 426 using the vibrating wire viscometer 400 illustrated in FIG. 4A. The test was performed using Kovar to implement the posts 410 and 412 and tungsten to implement the wire 408. The example test results illustrate a signal that may be observed at the example fluid thermometer 420 of FIG. 4A. In a first part 428 of the test results 426, ice was placed into contact with a first one of the posts (e.g., the post 410). The fluid thermometer 420 rapidly indicated a change in the voltage, relative to a baseline voltage, corresponding to the temperature difference (e.g., about 25 degrees Celsius) between the posts 410 and 412 caused by the contact between the ice and the post 410. When the ice was removed (at about 15 seconds), the temperature of the post 410 gradually returned to ambient. In contrast, in the second part 430 of the test results 426, the ice was placed into contact with a second one of the posts (e.g., the post 412). Accordingly, the polarity of the voltage indicated by the fluid thermometer 420 changes but the amplitude of the signal, relative to the baseline voltage, is substantially the same due to an equal but opposite temperature difference between the posts 404 and 406. The high frequency signal components illustrated in the example test results 426 are a result of the vibrating wire sensor 400 operating as a viscometer.

By changing the materials of one of the posts from Kovar (i.e., having different Seebeck coefficients between the thermocouple junctions 404 and 406), the thermocouple junctions 404 and 406 achieve a voltage difference similar to the differences illustrated in FIG. 4C when subjected to substantially the same temperature. Thus, the fluid thermometer 420 may determine the temperature based on the received signal from the thermocouple junctions 404 and 406.

Figure 5:
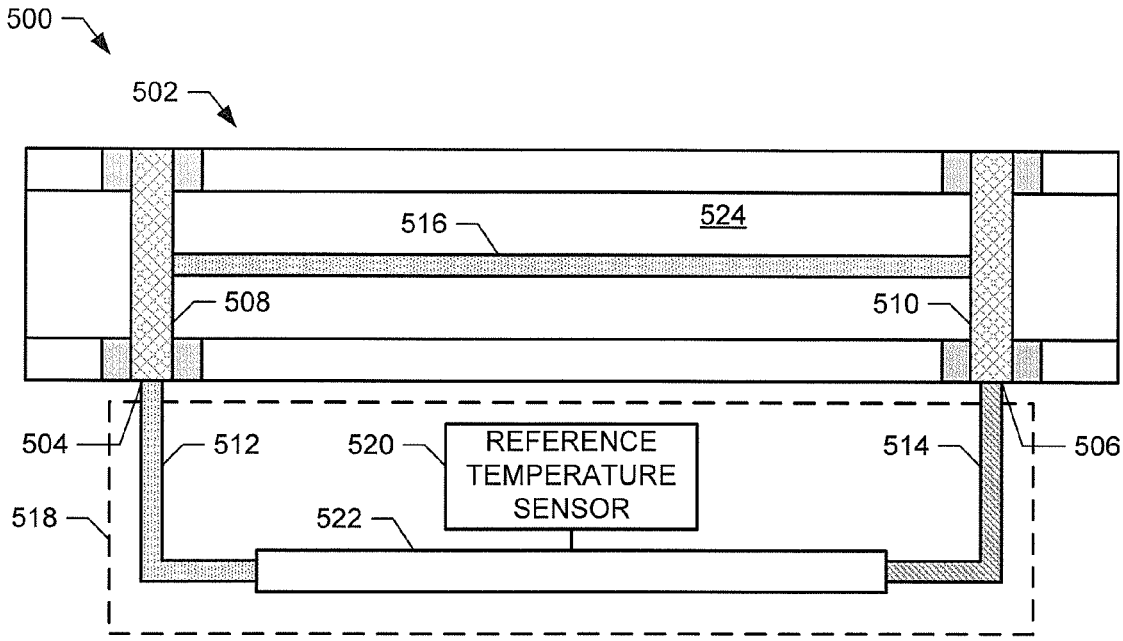
FIG. 5 is another example vibrating wire viscometer constructed to also provide a temperature sensor via thermocouple junctions between conductive posts and connecting materials.

FIG. 5 is another example vibrating wire viscometer 500 constructed to also provide a temperature sensor 502 via thermocouple junctions 504 and 506 between conductive posts 508 and 510 and connectors 512 and 514. In contrast to the example temperature sensor 402 of FIG. 4A, the temperature sensor 502 of FIG. 5 has thermocouple junctions between the conductive posts 508 and 510 and the connectors 512 and 514 instead of between a viscometer wire 516 and the conductive posts 508 and 510. The conductive posts 508 and 510 are composed of the same material, which may be the same or different than the material of the viscometer wire 516. The connector 512 is composed of a different material than the conductive post 508 and the connector 514 is composed of a material different than both the post 510 and the connector 512. For example, the example conductor 512 may be composed of lead (having a Seebeck coefficient of about 4 microvolts per Kelvin (μV/K)) and the example connector 514 may be composed of Constantan (having a Seebeck coefficient of about −5 μV/K). Of course, the Seebeck coefficient changes as the temperature of the material changes.

Similar to the example temperature sensor 402 of FIG. 4A, the example temperature sensor 502 includes a reference location 518 outside the fluid chamber 524. A reference temperature sensor 520 determines the temperature at the reference location 518. The example temperature sensor 502 further includes a fluid thermometer 522 that determines the temperature of the downhole fluid in a fluid chamber 524 based on the temperatures determined by the reference temperature sensor 520 and the thermocouple junctions 504 and 506.

Figure 6:
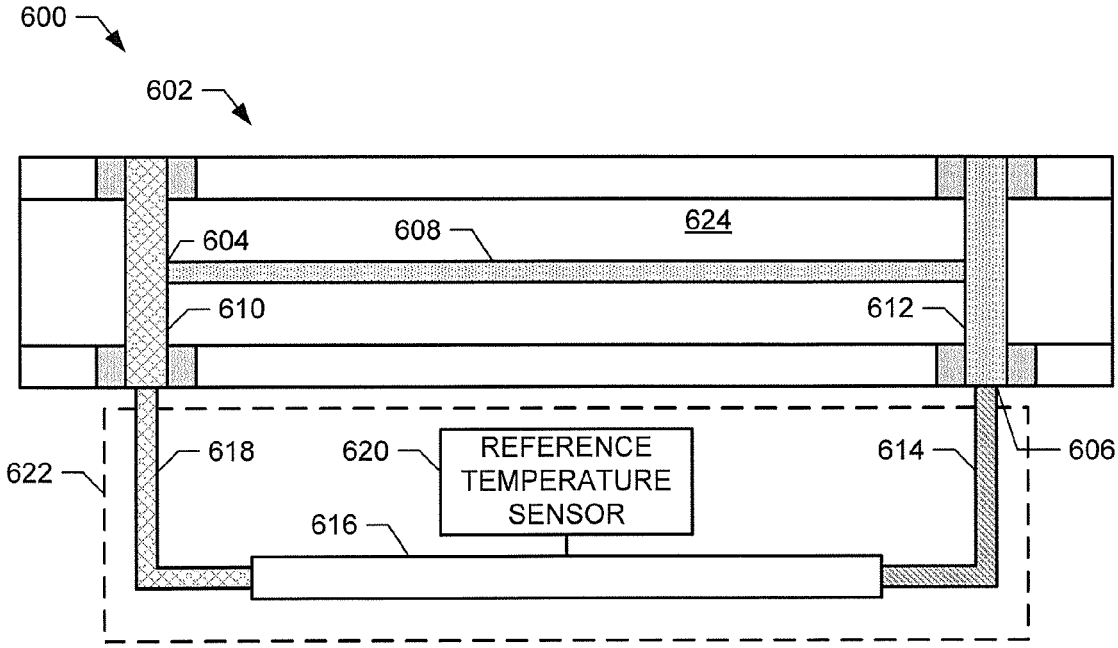
FIG. 6 is another example vibrating wire viscometer constructed to also provide a temperature sensor via thermocouple junctions between a wire and a first post and between a second post and a connecting material.

FIG. 6 is another example vibrating wire viscometer 600 constructed to also provide a temperature sensor 602 via thermocouple junctions 604 and 606 between a wire 608 and a first post 610 and between a second post 612 and a first connector 614. The first connector 614 couples the second post 612 to a fluid thermometer 616. A second connector 618 couples the first post 610 to the fluid thermometer 616. The temperature sensor 602 further includes a reference temperature sensor 620 to determine the temperature of a reference location 622 outside a fluid chamber 624.

The example thermocouple junction 604 is formed by the wire 608 and the first post 610. The first post 610 and the second connector 618 are composed of a first material and, thus, do not form a thermocouple junction. The wire 608 and the second post 612 are composed of a second material and do not form a thermocouple junction. The first connector 614 is composed of a third material and forms the thermocouple junction 606 in combination with the second post 612.

The fluid thermometer 616 is coupled to the thermocouple junction 604 via the first post 610 and the second connector 618. The fluid thermometer 616 is further coupled to the thermocouple junction 606 via the first connector 614. The temperature of the downhole fluid may be determined by the fluid thermometer 614 based on the temperature of the reference location 622 (e.g., determined by the reference temperature sensor 620) and the difference between the temperature of the reference location 622 and the downhole fluid (e.g., determined by the thermocouple junctions 604 and 606.

The example temperature sensors 502 and 602 of FIGS. 5 and 6 may also be represented by a schematic view similar to the schematic view shown in FIG. 4B. The temperature sensors 502 and 602 both include multiple thermocouple junctions thermally coupled to a downhole fluid, which is represented by the example schematic view of FIG. 4B. However, the thermocouple junctions and the conductors connecting the respective thermocouple junctions are represented by different combinations of the viscometer wire, the conductive posts, and the connectors.

Figure 7A:
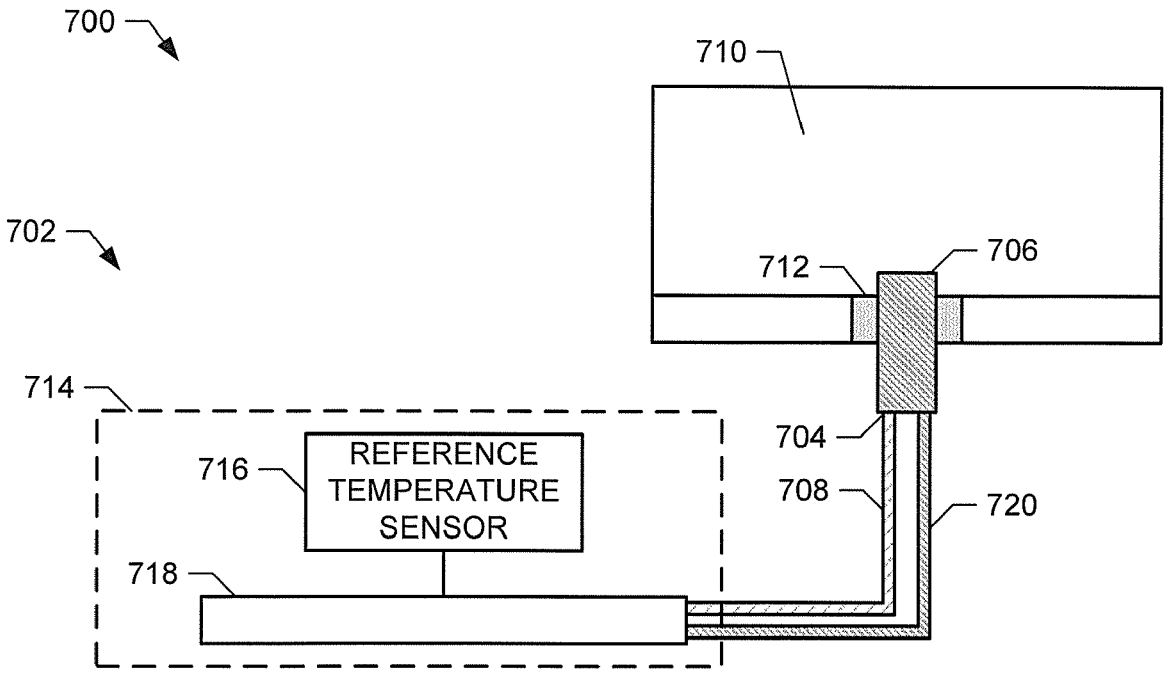
FIG. 7A is an example H2S sensor constructed to also provide a temperature sensor via thermocouple junctions between the H2S sensor and a connecting material.

FIG. 7A is an example H2S sensor 700 constructed to also provide a temperature sensor 702 via a thermocouple junction 704 between an H2S electrode 706 and a connector 708 (e.g., a wire). The H2S sensor 700, via the H2S electrode 706, determines the concentration of H2S in a downhole fluid within a fluid chamber 710. In addition, the H2S electrode 706 is thermally coupled to the downhole fluid. As a result, the H2S sensor 706 is substantially the same temperature as the downhole fluid and, thus, may be used as a thermocouple.

The example H2S electrode 706 is composed of a material used to detect H2S concentration. In contrast, the example connector 708 is composed of a different material than the H2S electrode 706. In particular, the material for the connector 708 may be chosen to have a Seebeck coefficient that is very different from the Seebeck coefficient of the material that composes the H2S electrode 706. For example, the example H2S electrode 706 may be composed of nickel (having a Seebeck coefficient of about −15 μV/K) and the example connector 708 may be composed of Chromel (having a Seebeck coefficient of about 30 to 35 μV/K). Of course, the Seebeck coefficient changes as the temperature of the material changes.

A seal 712 provides support to the H2S electrode 706 and prevents downhole fluid from penetrating or accessing a reference location 714. A reference temperature sensor 716 determines the temperature of the reference location 714. A fluid thermometer 718 is coupled to the reference temperature sensor 716 and to the junction 704 via the connector 708 and a second connector 720. The second connector 720 is composed of the same material as the H2S electrode 706 to avoid adding thermocouple junctions to the H2S sensor 700.

Figure 7B:
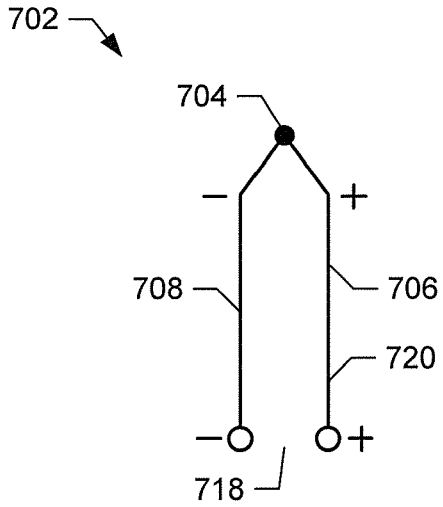
FIG. 7B is a schematic view of the example temperature sensor of FIG. 7A.

In operation, the fluid thermometer 718 determines the temperature of the fluid in the fluid chamber 710 by determining the temperature of the reference location 714 (e.g., determined by the reference temperature sensor 716) and the difference in temperature between the reference location 714 and the fluid chamber 710 (e.g., determined by the thermocouple junction 704). FIG. 7B is a schematic view of the example temperature sensor 702 of FIG. 7A. The example thermocouple junction 704 is coupled to the fluid thermometer 718 via the connector 708 and via the connector 720 and the electrode 706.

Figure 8:
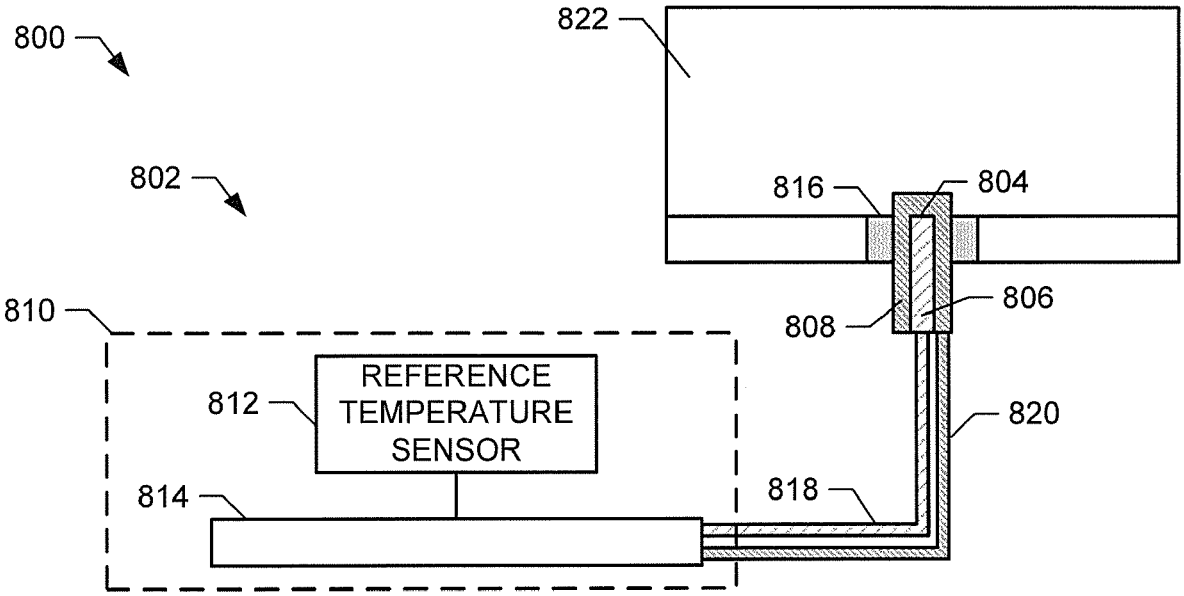
FIG. 8 is another example H2S sensor constructed to also provide a temperature sensor via a thermocouple composed of a first material enveloped in a second material.

FIG. 8 is another example H2S sensor 800 constructed to also provide a temperature sensor 802 having a thermocouple junction 804 between a first material 806 and a second material 808. Similar to the example temperature sensor 702 of FIG. 7A, the example temperature sensor 802 includes a reference location 810, a reference temperature sensor 812, and a fluid thermometer 814.

In contrast to the example thermocouple junction 704 of FIG. 7A, the example thermocouple junction 804 is composed of the first material 806 that is covered or enveloped by the second material 808. The second material 808 is a material that may be used to measure the H2S concentration of a downhole fluid (e.g., an H2S electrode). In combination with a seal 816, the second material 808 prevents downhole fluid from contacting and potentially damaging the first material 806, while transmitting sufficient heat to thermally couple the downhole fluid to the first material 806, thereby causing the temperature of the first material 806 to substantially equal the temperature of the downhole fluid. Thus, the first and second materials 806 and 808 function as both an H2S electrode and as a thermocouple junction.

The fluid thermometer 814 is coupled to the first material 806 via a first connector 818 composed of the first material, and is coupled to the second material 808 via a second connector 820 composed of the second material. Similar to the example temperature sensor 704 of FIG. 7A, the example temperature sensor 804 determines the temperature of a downhole fluid in a fluid chamber 822 based on the temperature of the reference location 810 (e.g., determined by the reference temperature sensor 812) and the difference in temperature between the reference location 810 and the fluid chamber 822 (e.g., determined by the thermocouple junction 804). The thermocouple junction 804 is exposed to the temperature of the fluid chamber 822 via the second material, which, in operation, is in contact with the downhole fluid in the fluid chamber 822.

The example H2S sensors 700 and 800 of FIGS. 7A and 8 may be modified to implement different sensors to measure other, non-thermal chemical and/or physical properties. For example, the H2S sensors 700 and 800 may be replaced by a resistivity sensor.

Figure 9:
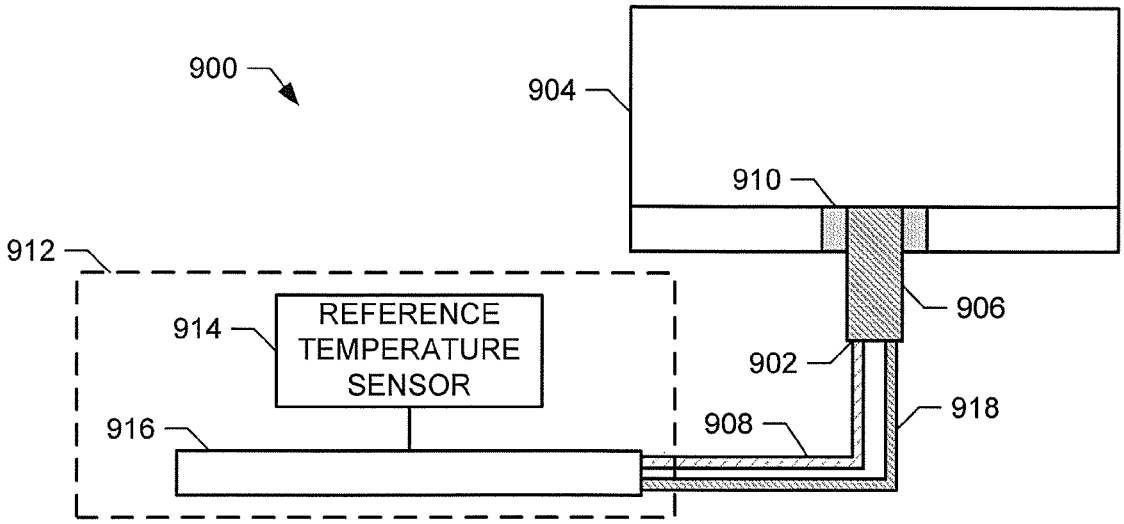
FIG. 9 is an example thermocouple exposed to a downhole fluid to measure the temperature of the fluid.

FIG. 9 is an example temperature sensor 900 including a thermocouple junction 902 exposed to a downhole fluid in a fluid chamber 904. The example temperature sensor 900 may be used when an electrode, such as a vibrating wire viscometer and/or an H2S sensor, is not already installed. The thermocouple junction 902 is composed of an electrode 906, which is composed of a first material and a second material 908 coupled to the first material 906. The electrode 906 is exposed to the downhole fluid in the fluid chamber 904 and, in combination with a seal 910, prevents the downhole fluid from contacting the second material 908 or a reference location 912. In some examples, the seal 910 is implemented by welding or brazing the first material 906 to the fluid chamber 904.

The example temperature sensor 900 further includes a reference temperature sensor 914 and a fluid thermometer 916. The reference temperature sensor 914 measures the temperature of the reference location 912. The fluid thermometer 916 is coupled to the junction 902 via the second material 908 and a connector 918 composed of the first material. Thus, the connector 918 does not add a thermocouple junction to the circuit.

Figure 10:
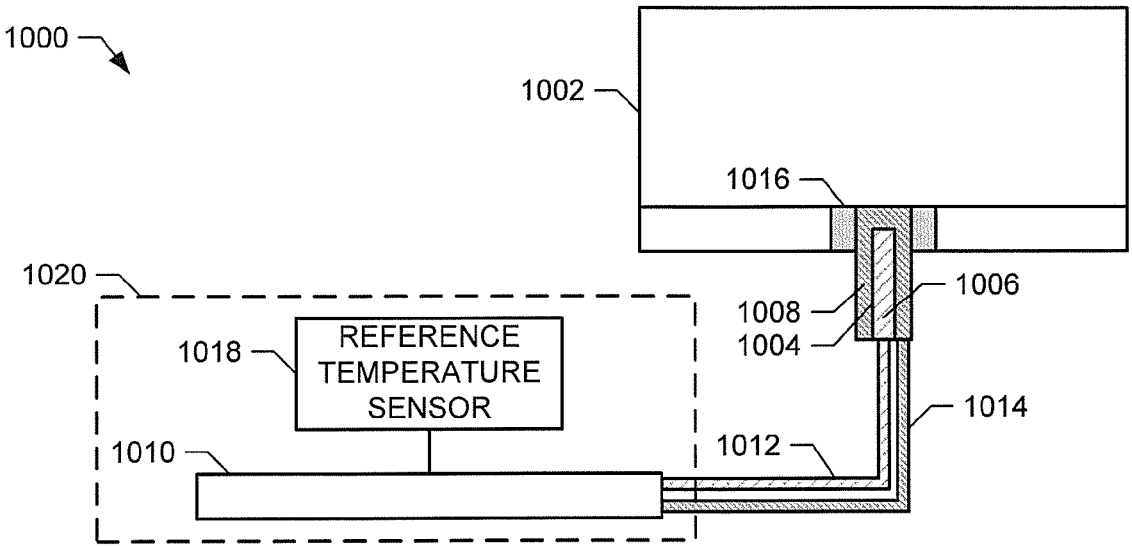
FIG. 10 is another example thermocouple exposed to a downhole fluid to measure the temperature of the fluid and having a thermocouple composed of a first material enveloped in a second material.

FIG. 10 illustrates another example thermocouple 1000 exposed to a downhole fluid in a fluid chamber 1002 to measure the temperature of the fluid. The example thermocouple 1000 has a thermocouple junction 1004 composed of a first electrode 1006 covered by or enveloped in a second electrode 1008. The thermocouple junction 1004 is coupled to a fluid thermometer 1010 via a first connector 1012 and a second connector 1014. The first connector 1012 couples the first electrode 1006 to the fluid thermometer 1010 and is composed of the same material as the first electrode 1006. Similarly, the second connector 1014 couples the second first electrode 1008 to the fluid thermometer 1010 and is composed of the same material as the first electrode 1008.

The second electrode 1008 is sealed to the fluid chamber 1002 by, for example, welding or brazing the second electrode 1008 to the fluid chamber 1002. The seal 1016 prevents communication between the downhole fluid within the fluid chamber 1002 and the first electrode 1006 and/or the fluid thermometer 1010. A reference temperature sensor 1018 determines the temperature of a reference location 1020. The fluid thermometer 1010 determines the temperature of the downhole fluid based on the temperature of the reference location 1020 (e.g., determined by the reference temperature sensor 1018) and the difference between the reference location 1020 and the downhole fluid in the fluid chamber 1002 (e.g., determined by the thermocouple junction 1004).

The example temperature sensors 802, 900, and 1000 of FIGS. 8-10 may also be represented by a schematic view similar to the schematic view shown in FIG. 7B. The temperature sensors 802, 900, and 1000 each include a thermocouple junction thermally coupled to a downhole fluid, which is represented by the example schematic view of FIG. 7B. However, the thermocouple junctions and the conductors connecting the respective thermocouple junctions are represented by different combinations of electrodes and/or connectors.

As should be apparent from the foregoing, the example apparatus described herein may be used to rapidly sense the temperature and/or changes in the temperature of a downhole fluid. Additionally or alternatively, the example apparatus described herein may be implemented downhole using sensors that determine other physical and/or chemical properties of the downhole fluid. Thus, the example apparatus may be more reliable and/or rugged than known downhole temperature sensors. Accordingly, the example apparatus described herein may be easily integrated into downhole fluid testing and/or sensing systems.

Although example methods, apparatus and articles of manufacture have been described herein, the scope of coverage of this patent is not limited thereto. On the contrary, this patent covers every apparatus, method and article of manufacture fairly falling within the scope of the appended claims either literally or under the doctrine of equivalents.

What is claimed is:

1. A sensor for measuring a temperature of a downhole fluid comprising:

a sensing element for measuring a physical or chemical property of the downhole fluid;

a plurality of electrical connections to enable the sensing element to measure the chemical or physical property and provide an output signal representative of the chemical or physical property, wherein at least one of the electrical connections is configured to function as a thermocouple to sense a temperature of the downhole fluid; and a fluid thermometer to determine the temperature of the downhole fluid based on a reference temperature determined by a temperature sensor and a temperature difference between the reference temperature and the temperature of the downhole fluid, wherein the fluid thermometer electrically coupled to a first electrode and a second electrode, wherein the first electrode is coupled to a housing and is disposed within a fluid chamber, and wherein the second electrode is coupled to the housing and is disposed within the fluid chamber.

2. A sensor as defined in claim 1, wherein the plurality of electrical connections comprises an electrode that is thermally coupled to the downhole fluid.

3. A sensor as defined in claim 2, wherein the electrode comprises at least one of a hydrogen sulfide sensor, a wire viscometer, or a resistivity sensor.

4. A sensor as defined in claim 2, wherein the electrode prevents access to a second one of the electrical connections by the downhole fluid.

5. A sensor as defined in claim 1, wherein the temperature sensor comprises at least one of a resistance temperature detector, a thermistor, a silicon bandgap temperature sensor, an infrared thermometer, or a heat flux sensor.

6. A sensor for measuring downhole fluid temperatures, comprising:

a first electrode coupled to a housing and disposed within a fluid chamber;

a second electrode coupled to the housing and disposed within the fluid chamber;

a viscometer wire electrically coupled to the first and second electrodes;

a temperature sensor disposed outside of the fluid chamber; and a fluid thermometer electrically coupled to the first and second electrodes and to the temperature sensor to determine a temperature of a fluid within the fluid chamber.

7. A sensor as defined in claim 6, wherein the fluid chamber comprises a flowline.

8. A sensor as defined in claim 6, wherein the fluid thermometer determines the temperature of the fluid based on a first temperature determined by the temperature sensor and a temperature difference between first and second thermocouples.

9. A sensor as defined in claim 8, wherein the first electrode comprises a first material, the viscometer wire comprises a second material, and the first electrode and the viscometer wire form the first thermocouple.

10. A sensor as defined in claim 9, wherein the second electrode comprises a third material, and the viscometer wire and the second electrode form the second thermocouple.

11. A sensor as defined in claim 9, wherein the second electrode comprises the first material, the temperature sensor is coupled to the second electrode via a third material, and the second electrode and the third material form the second thermocouple.

12. A sensor as defined in claim 8, wherein the first and second electrodes comprise a first material, the temperature sensor is coupled to the first electrode via a second material and coupled to the second electrode via a third material, the first electrode and the second material form the first thermocouple, and the second electrode and the third material form the second thermocouple.

13. A sensor for measuring downhole fluid temperatures, comprising:

a first electrode comprising a first material, sealingly coupled to a fluid chamber, and thermally coupled to downhole fluid in the fluid chamber;

a second electrode comprising a second material and in contact with the first electrode to form a thermocouple;

a temperature sensor disposed outside of the fluid chamber; and a fluid thermometer electrically coupled to the first and second electrodes and to the temperature sensor to determine a temperature of the downhole fluid in the fluid chamber.

14. A sensor as defined in claim 13, wherein the first electrode prevents access to the second electrode by the downhole fluid.

15. A sensor as defined in claim 13, wherein the first electrode comprises a hydrogen sulfide sensor or a resistivity sensor.

16. A sensor as defined in claim 13, wherein the fluid thermometer is coupled to the first electrode via a first connector comprising the first material.

17. A sensor as defined in claim 16, wherein the fluid thermometer is coupled to the second electrode via a second connector comprising the second material.

18. A sensor as defined in claim 13, wherein the fluid thermometer determines the temperature of the downhole fluid based on a reference temperature determined by the temperature sensor and a temperature difference between the reference temperature and the temperature of the downhole fluid.

19. A sensor as defined in claim 13, wherein the temperature sensor comprises at least one of a resistance temperature detector, a thermistor, a silicon bandgap temperature sensor, an infrared thermometer, or a heat flux sensor.

20. A system for measuring downhole fluid temperatures, comprising:

a downhole tool having a sensor for the downhole fluid temperatures, the sensor comprising:

a first electrode coupled to a housing and disposed within a fluid chamber;

a second electrode coupled to the housing and disposed within the fluid chamber;

a viscometer wire electrically coupled to the first and second electrodes;

a temperature sensor disposed outside of the fluid chamber; and a fluid thermometer electrically coupled to the first and second electrodes and to the temperature sensor to determine a temperature of a fluid within the fluid chamber.

* * * * *